US005304862A

United States Patent [19]

Memida

[11] Patent Number: 5,304,862

[45] Date of Patent: Apr. 19, 1994

[54] CONSTANT CURRENT CIRCUIT

[75] Inventor: Yuuichi Memida, Nara, Japan

[73] Assignee: Sharp Kabushiki Kaisha, Osaka, Japan

[21] Appl. No.: 42,003

[22] Filed: Apr. 2, 1993

[30] Foreign Application Priority Data

Apr. 2, 1992 [JP] Japan ..... 4-110900

[51] Int. Cl.[5] ..... G05F 3/02

[52] U.S. Cl. ..... 307/296.6; 307/296.4; 323/315

[58] Field of Search ..... 307/296.6, 296.8, 296.4, 307/296.1, 296.2, 296.5; 330/257, 288; 323/315

[56] References Cited

U.S. PATENT DOCUMENTS 4,103,249 7/1978 Burdick ..... 307/296.6
4,396,883 8/1983 Holloway et al. ..... 307/296.6
5,027,004 6/1991 Palara ..... 307/296.6
5,045,718 9/1991 Vanderhoydonck et al. ... 307/296.4
5,063,305 11/1991 Minami et al. ..... 307/296.4

*Primary Examiner*—William L. Sikes
*Assistant Examiner*—My-Trang Ton

[57] ABSTRACT

In a starting circuit of a constant current circuit utilized in semiconductor integrated circuits, when a starting transistor is turned on upon the application of a power supply potential, a feedback transistor is turned on whereupon a first current mirror circuit, a second current mirror circuit and feedback transistor form a current feedback loop. If a defect, such as disconnection is present, the starting transistor in the starting circuit is prevented from operating. The feedback transistor cannot turn on and the current feedback loop cannot be completed. Making use of such a circuit characteristic, detection of a defect in the circuit can be made simply by checking to see whether or not the circuit operates upon turn-on of the power supply used to power the circuit.

8 Claims, 4 Drawing Sheets

CONSTANT CURRENT CIRCUIT

BACKGROUND OF THE INVENTION

1. Field of the Invention

The present invention relates to a constant current circuit which is one of basic circuits in semiconductor integrated circuits, and particularly to a constant current circuit including a current feedback loop having a current mirror circuit of a band gap type.

2. Description of the Background Art

A semiconductor integrated circuit is provided with a constant current circuit for supplying each part of the circuit with a constant current. The constant current circuit of this type includes a starting circuit for ensuring operation of the circuit when a power supply is turned on.

FIGS. 3 and 4 are schematic diagrams of conventional constant current circuits each including a starting circuit.

First, the constant current circuit in FIG. 3 will be described. A PNP type transistor Q1, an NPN type transistor Q4 and a resistor R1 are connected in series between a power supply node 1 receiving a power supply potential and a ground node 2 receiving a ground potential. A PNP type transistor Q2 and an NPN type transistor Q5 are also connected in series between power supply node 1 and ground node 2. A PNP type transistor Q3, an NPN type feedback transistor Q6 and a resistor R3 are further connected in series between power supply node 1 and ground node 2. A PNP transistor Q9 is connected between power supply node 1 and an output node 3. A resistor R2 is connected in parallel to transistor Q6 between the collector of transistor Q3 and one end of resistor R3.

Transistors Q1, Q2 Q3 and Q9 have respective bases connected to each other, and connected to the collector of transistor Q3, the collector of transistor Q6 and one end of resistor R2. Transistor Q6 has its base connected to a node between the collectors of transistor Q2 and transistor Q5. Transistors Q4 and Q5 have respective bases connected to each other. Transistor Q4 has its base and collector short-circuited.

In the constant current circuit, transistors Q1, Q2, Q3 and Q9 constitute a first current mirror circuit $\alpha$. Transistors Q4 and Q5 and resistor R1 constitute a second current mirror circuit $\beta$ of a band gap type. Resistors R2 and R3 constitute a starting circuit $\gamma 2$. Current mirror circuit $\beta$ of the band gap type is a circuit for conducting a current of a level determined based on a current density difference between two transistors Q4 and Q5 constituting current mirror circuit $\beta$ and a resistance value of resistor R1, to first current mirror circuit $\alpha$.

In the operation of the constant current circuit of FIG. 3, when the power supply is turned on, each base current of transistors Q1, Q2, Q3 and Q9 flows through resistors R2 and R3 to ground node 2, whereby a current flows from the collector of transistor Q2 to the base of feedback transistor Q6 to turn transistor Q6 on.

When feedback transistor Q6 is turned on, each base current of transistors Q1, Q2, Q3 and Q9 then flows through feedback transistors Q6 and resistor R3 to ground node 2, resulting in increase of the base currents and thus collector currents of transistors Q1, Q2, Q3 and Q9.

The increase in the collector current of transistor Q1 is followed by increase of a collector current of transistor Q4, resulting in increase of a base-emitter voltage of transistor Q4. Since the bases of transistors Q4 and Q5 constituting a current mirror circuit have equal potentials, a collector current of transistor Q5 increases with the increase in that of transistor Q4.

In second current mirror circuit $\beta$, when respective collector currents of transistors Q1 and Q2 increase to attain a stable current value determined based on a current density difference between transistors Q4 and Q5 of second current mirror circuit $\beta$ and a resistance value of resistor R1, the collector current of transistor Q2 flows into not only the base of feedback transistor Q6, but also transistor Q5.

Consequently, a base current and thus a collector current are made constant in feedback transistor Q6. When the collector current of feedback transistor Q6 becomes constant, the collector currents of transistors Q1, Q2, Q3 and Q9 increased in first current mirror circuit $\alpha$ become constant to make the constant current circuit stable as a whole, whereby a current provided from output transistor Q9 through output node 3 is made constant.

The constant current circuit in FIG. 4 will now be described. Since the basic structure of the constant current circuit in FIG. 4 is the same as that in FIG. 3, like numerals are attached to like parts, and the description thereof is not repeated. The difference between the constant current circuits in FIGS. 3 and 4 will be described in the following. The structure of a starting circuit $\gamma 3$ in the constant current circuit of FIG. 4 is different from that of starting circuit $\gamma 2$ in the constant current circuit of FIG. 3.

Starting circuit $\gamma 3$ comprises an NPN type transistor Q7 and a resistor R4. Transistor Q7 and resistor R4 are connected in series between a power supply node 1 and a ground node 2. Transistor Q7 has its base connected to respective bases of transistors Q1, Q2, Q3 and Q9 of first current mirror circuit $\gamma$.

In the operation of the constant current circuit of FIG. 4, when the power supply is turned on, each base current of transistor Q1, Q2, Q3 and Q9 flows through transistor Q7 and resistor R4 to ground node 2, whereby a current flows from the collector of transistor Q2 to the base of transistor Q6 to turn transistor Q6 on. Thereafter, the same operation as in the constant current circuit of FIG. 3 is carried out, so that the constant current circuit in FIG. 4 is made stable, ensuring the operation thereof.

In the constant current circuits shown in FIGS. 3 and 4, however, there exist the following problems.

In such a constant current circuit, after manufacturing the same, a test is made on the function of the circuit, where the constant current circuit is operated on trial for evaluation of the quality of the product based on the operation result.

In each of the constant current circuits in FIGS. 3 and 4 a wiring for an attached part tends to be disconnected, because it is a semiconductor integrated circuit having a structure in which the wiring is provided by vapor deposition of aluminum. For example, disconnection tends to occur at the points e and f in the constant current circuit of FIG. 3, and at the points g, h and i in the constant current circuit of FIG. 4. If such disconnection occurs in the constant current circuit of FIG. 3 or 4, feedback transistor Q6 is not usually turned on, and the circuit does not operate. Therefore, it is possible to determine the presence or absence of a defective part therein.

However, if the power supply potential suddenly rises on turning on the power supply, or if noise enters the circuit, a very small leak current flow through transistor Q2 might be generated. This could cause feedback transistor Q6 to be momentarily turned on, allowing the base currents to flow through transistor Q1, Q2, Q3 and Q9. As a result, the constant current circuit is started to operate, despite the disconnection in the circuit.

As described above, the conventional constant current circuit might operate despite disconnection therein, because of a leak current induced by noise. In order to exclude this possibility, several measures to eliminate noise are taken in a test apparatus for testing the circuit, such as provision of a shield preventing noise from entering the circuit, as well as gradual raise of a voltage immediately after turning on the power supply. However, all noise in the circuit can not be eliminated at the time of testing by the test apparatus since many parts are attached to the circuit to be tested.

Therefore, a problem exists that disconnection in a constant current circuit is difficult to be detected in the prior art, which leads to shipment of defective circuits. Accordingly, if such circuit having a disconnected portion is actually used by a user, disadvantage might occur that a circuit which operated in the test does not operate in the actual use, depending on the presence or absence of noise entering the circuit, and the conditions on which the circuit is used, such as the temperature of the environment. In addition, a problem exists that stricter measures against noise will lead to increase of time and costs required for the test, and reduction of a shipment rate.

SUMMARY OF THE INVENTION

One object of the present invention is to ensure detecting of defects, such as disconnection, in a constant current circuit.

Another object of the present invention is to reduce time and costs required for a test of a constant current circuit.

A constant current circuit in accordance with the present invention includes a first current mirror circuit providing an output current, a second current mirror circuit determining a reference current of the first current mirror circuit, a feedback transistor performing current feedback for controlling the output current of the first current mirror circuit to match the reference current, and a starting circuit.

The starting circuit starting the first current mirror circuit and the feedback transistor includes a ground node and a switching element. The ground node receives a ground potential. The switching element is connected between at least the first current mirror circuit and the ground node, to operate in response to a signal provided from the first current mirror circuit.

In the starting operation of the first current mirror circuit, the switching element of the starting circuit is turned on in response to an applied signal from the first current mirror circuit. This causes a current passage between the first current mirror circuit and the feedback transistor, and the ground node, to be closed, rendering the feedback transistor in the active state, whereby the first current mirror circuit and the feedback transistor are started. An output current provided from the first current mirror circuit is controlled to match the reference current determined in the second current mirror circuit by current feedback of the feedback transistor.

When the switching element of the starting circuit is turned on, the first current mirror circuit and the feedback transistor are thus started, while when disconnection occurs between the first current mirror circuit and the feedback transistor, and the switching element, the switching element does not operate, and the first current mirror circuit and the feedback transistor can not be started.

Since the presence of a defect, such as disconnection, in the circuit will completely prevent the first current mirror circuit and the feedback transistor from operating even when the power supply is turned on, identification of the circuit as a defective one in the test can be allowed, ensuring detection of a constant current circuit having disconnection regardless of the presence or absence of noise. Therefore, measures against noise are not required in the test, and consequently time and costs required for the test of the circuit can be reduced.

The constant current circuit in accordance with another aspect of the present invention includes a power supply node receiving a power supply potential, a ground node receiving a ground potential, a first current mirror circuit, a second current mirror circuit, a feedback transistor and a starting circuit.

The first current mirror circuit has its input node connected to the power supply node, and provides from its output node a current corresponding to the base current. The second current mirror circuit, of a band gap type, is connected between the output node of the first current mirror circuit and the ground node to determine a reference current for an output current of the first current mirror circuit. The feedback transistor has its base connected to a node between the first current mirror circuit and the second current mirror circuit, and its collector connected to the base and collector of the first current mirror circuit, to perform current feedback to the first current mirror circuit in response to the base current. The starting circuit is connected between the feedback transistor and the first current mirror circuit, and the ground node, to start the first current mirror circuit and the feedback transistor.

The starting circuit includes a starting transistor, and first and second resistors. The starting transistor has its emitter grounded to the ground node. The first resistor is connected between the collector of the feedback transistor and the base of the starting transistor. The second resistor is connected between the emitter of the feedback transistor and the collector of the starting transistor.

In the starting operation of the first current mirror circuit, the base current of the first current mirror circuit flows through the first resistor to the base of the starting transistor of the starting circuit, whereby the starting transistor is started. This causes a current passage between the feedback transistor and the ground node to be closed, allowing a current flow from the first current mirror circuit to the base of the feedback transistor, whereby the feedback transistor is started. Therefore, the current flows from the first current mirror circuit through the feedback transistor, the second resistor and the starting transistor, increase in which leads to increase in an output current of the first current mirror circuit. The increased output current is controlled to match the reference current determined in the second current mirror circuit, by current feedback of the feedback transistor.

When the starting transistor of the starting circuit is operated, the first current mirror circuit and the feedback transistor are thus started, while when disconnection occurs between the first current mirror circuit and the feedback transistor, and the starting transistor, or between the starting transistor and the ground node, the starting transistor does not operate due to the intrinsic characteristics of the transistor, and the first current mirror circuit and the feedback transistor can not be started.

Since the presence of a defect, such as disconnection, in the circuit will completely prevent the first current mirror circuit and the feedback transistor from operating even when the power supply is turned on, identification of the circuit as a defective one in the test can be allowed, ensuring detection a constant current circuit having defect, such as disconnection, regardless of the presence or absence of noise. Therefore, measures against noise are not required in the test, and time and costs required for the test of the circuit can be reduced.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
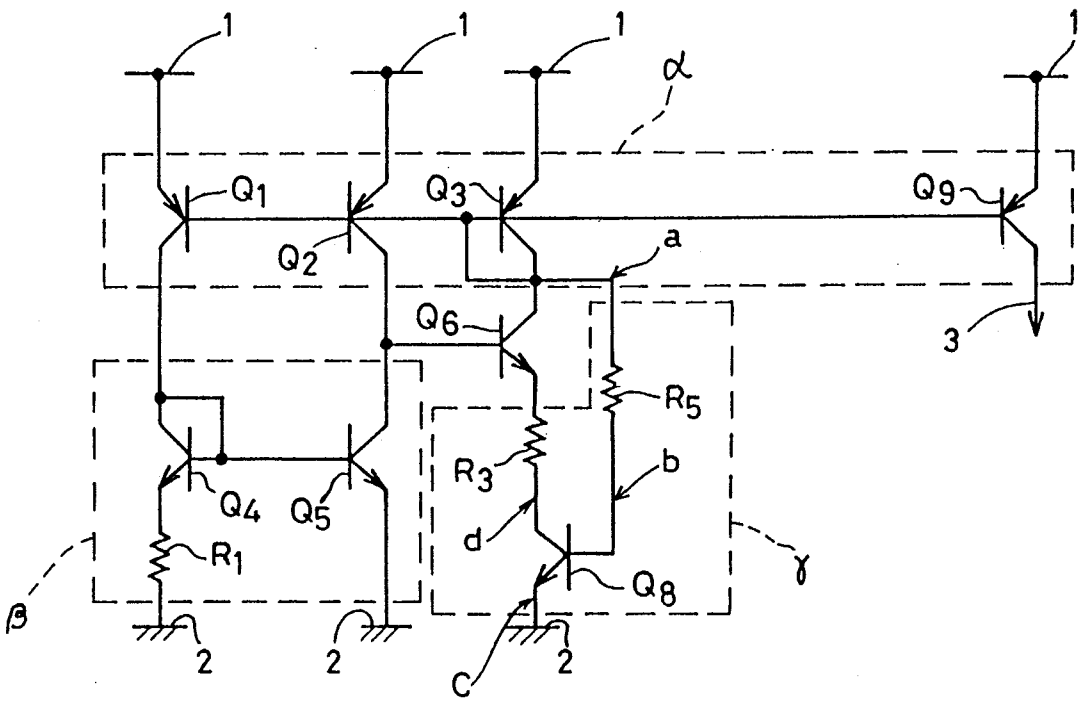
FIG. 1 is a schematic diagram of a constant current circuit according to one embodiment of the present invention.

FIG. 1 is a schematic diagram of a constant current circuit according to one embodiment of the present invention. A PNP type transistor Q1, an NPN type transistor Q4 and a resistor R1 are connected in series between a power supply node 1 receiving a power supply potential and a ground node 2 receiving a ground potential. A PNP type transistor Q2 and an NPN type transistor Q5 are also connected in series between power supply node 1 and ground node 2. A PNP type transistor Q3, an NPN type feedback transistor Q6, a resistor R3, and an NPN starting transistor Q8 are further connected in series between power supply node 1 and ground node 2. A PNP transistor Q9 is connected between power supply node 1 and output node 3. A resistor R5 is connected between the collector of feedback transistor Q6 and the base of starting transistor Q8.

Transistors Q1, Q2, Q3 and Q9 have respective bases connected to each other, and connected to the collector of transistor Q3, the collector of feedback transistor Q6 and one end of resistor R5. Feedback transistor Q6 has its base connected to a node between the collectors of transistor Q2 and transistor Q5. The base of transistor Q4 and the base of transistor Q5 are connected to each other. Transistor Q4 has its base and collector short-circuited.

In this circuit, transistors Q1, Q2, Q3 and Q9 constitute a first current mirror circuit $\alpha$, and transistors Q4 and Q5 and resistor R1 constitute a second current mirror circuit $\beta$ of a band gap type. Resistors R3 and R5 and starting transistor Q8 constitute a starting circuit $\gamma$. First current mirror circuit $\alpha$, second current mirror circuit $\beta$ and feedback transistor Q6 form a current feedback loop for controlling an output current of the constant current circuit to a constant value.

In the operation of the constant current circuit of FIG. 1, when power is supplied, the potential of power supply node 1 rises, and a current flows from the base of each of transistors Q1, Q2, Q3 and Q9 of first current mirror circuit $\alpha$ through resistor R5 to the base of starting transistor Q8. When the base current flows through starting transistor Q8, starting transistor Q8 is turned on, and a current passage between feedback transistor Q6 and ground node 2 is short-circuited. This causes a current flow from the collector of transistor Q2 to the base of feedback transistor Q6, to turn feedback transistor Q6 on.

This allows each base current of transistors Q1, Q2, Q3 and Q9 of first current mirror circuit $\alpha$ to flow through feedback transistor Q6, resistor R3 and starting transistor Q8 to ground node 2, resulting in increase of the base current and thus each collector current of transistor Q1, Q2, Q3 and Q9.

In second mirror circuit $\beta$, when respective collector currents of transistors Q1 and Q2 increase to attain a stable current value determined based on the current density difference between transistors Q4 and Q5 of second current mirror circuit $\beta$, and a resistance value of resistor R1, the collector current of transistor Q2 flows into not only the base of feedback transistor Q6, but also transistor Q5.

As a result, the base current and thus the collector current of feedback transistor Q6 are made constant. When the collector current of feedback transistor Q6 become constant, each collector current of transistors Q1, Q2, Q3 and Q9 increased in first current mirror circuit $\alpha$ becomes constant and the constant current circuit is made stable as a whole, whereby a current provided from transistor Q9 through output node 3 is made constant.

In the constant current circuit, a current feedback loop is formed of first current mirror circuit $\alpha$, second current mirror circuit $\beta$ and feedback transistor Q6. However, the current feedback loop is not formed and thus the constant current circuit does not operate, so long as starting transistor Q8 of starting circuit $\gamma$ is not turned on to operate feedback transistor Q6.

Specifically, in starting circuit $\gamma$, points indicated by a, b, c and d in FIG. 1 tend to be disconnected, as is characteristic of a semiconductor integrated circuit. If any of the points is disconnected, starting transistor Q8 is not turned on according to the characteristics of a transistor. Accordingly, the base current does not flow into feedback transistor Q6, not allowing feedback transistor Q6 to be turned on. Therefore, the above mentioned current feedback loop can not be formed, whereby the constant current circuit does not operate.

As described above, since any defect, such as disconnection, in the constant current circuit prevents starting transistor Q8 of starting circuit $\gamma$ from being turned on, feedback transistor Q6 is not turned on even if a leak current is generated in transistor Q2 because of sudden rise of the power supply potential and external noise in the test. Since such a defect as disconnection in the circuit prevents the constant current circuit from operating even when the power supply is turned on, a test whether the operation is performed or not can be allowed, ensuring detection of the defect in the constant current circuit. In addition, since such a defect as disconnection in the constant current circuit prevents the circuit from operating irrespective of the presence or absence of a leak current caused by noise or the like, conventional measures against noise, such as elimination of noise and gradual rise of the power supply potential, in the test are not required unlike in the prior art, whereby time and costs required for the test can be reduced.

The present invention is not limited to the constant current circuit shown in FIG. 1, and is applicable to any constant current circuit including a current mirror circuit of a band gap type. The constant current circuit shown in FIG. 2 is one example.

Figure 2:
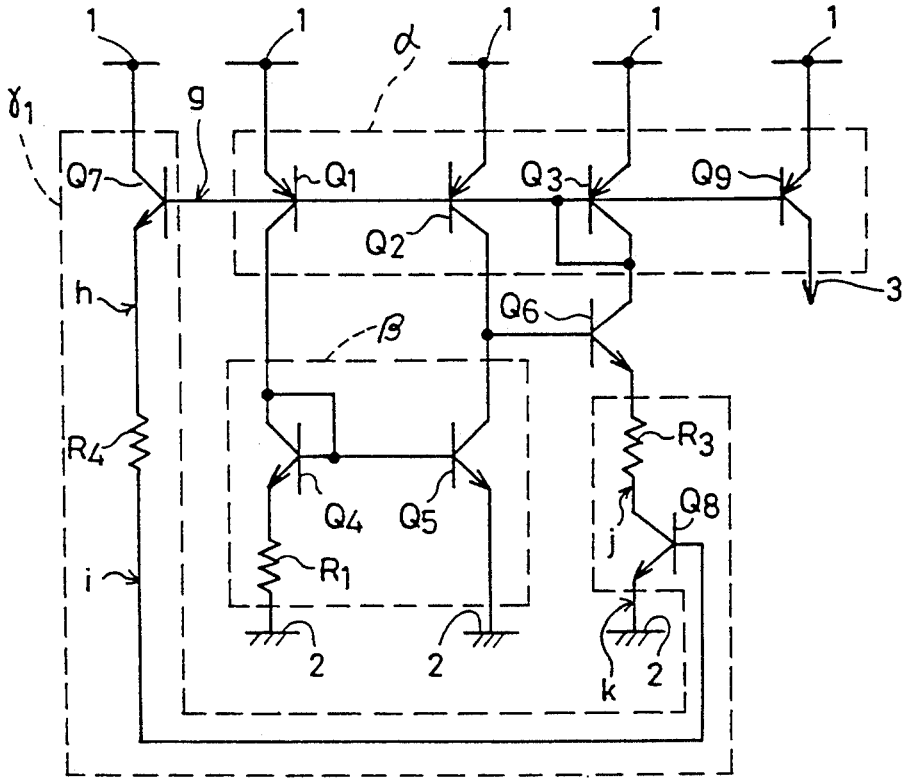
FIG. 2 is a schematic diagram of a constant current circuit according to another embodiment of the present invention.
Figure 3:
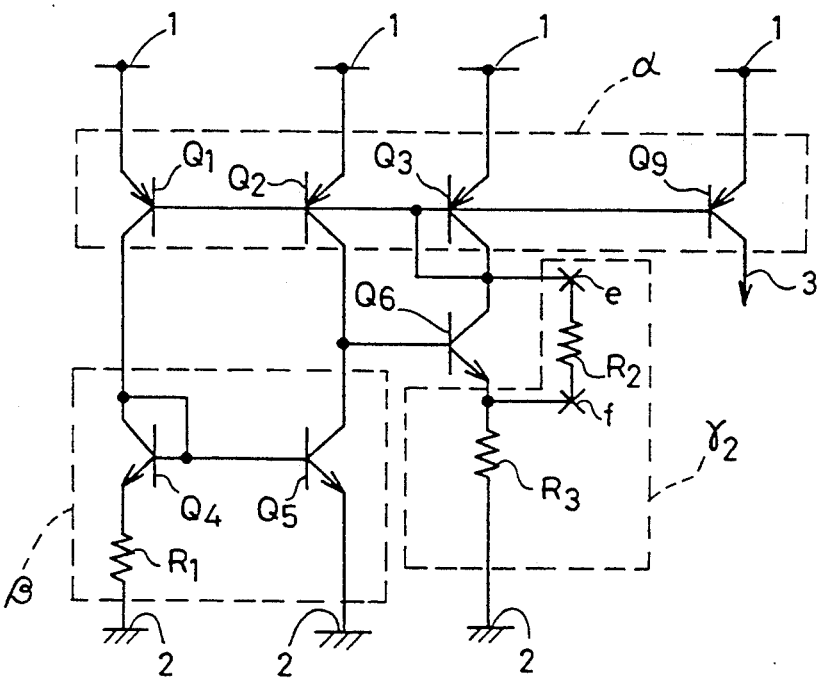
FIG. 3 PRIOR ART
FIGS. 3 and 4 are schematic diagrams of conventional constant current circuits.
Figure 4:
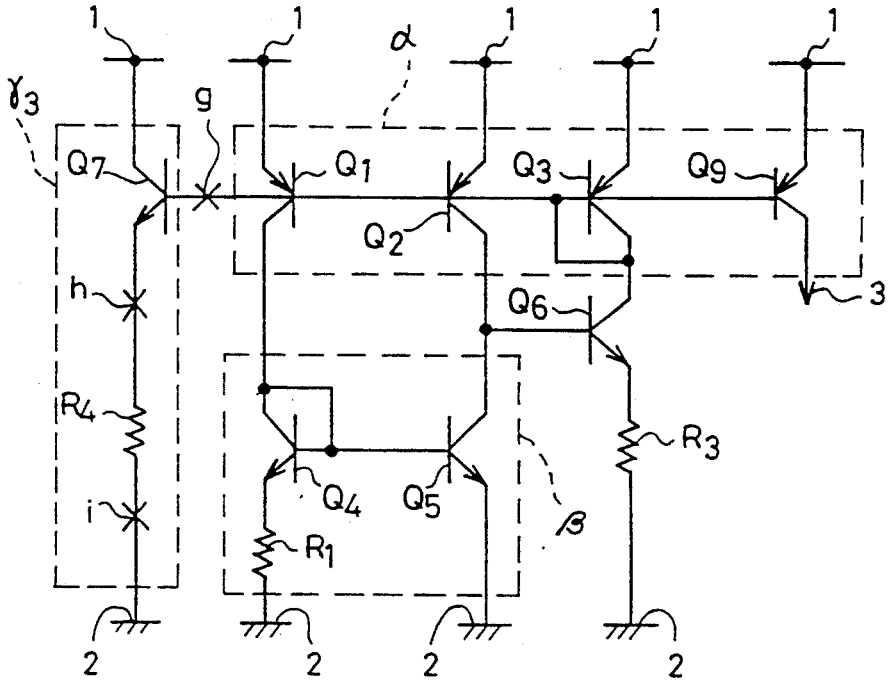
FIG. 4 PRIOR ART

FIG. 2 is a schematic diagram of a constant current circuit according to another embodiment of the present invention. Since the basic structure of the constant current circuit in FIG. 2 is the same as that in FIG. 1, like numerals are attached to like parts, and the description thereof is not repeated. The structure of a starting circuit $\gamma 1$ in the constant current circuit of FIG. 2 is different from that of the starting circuit in FIG. 1.

Starting circuit $\gamma 1$ includes a transistor Q7, a resistor R4, a resistor R3 and a starting transistor Q8. Transistors Q7 and Q8 are of an NPN type. Resistor R3 and starting transistor Q8 are connected in series between the emitter of feedback transistor Q6 and ground node 2. Transistor Q7 and resistor R4 are connected in series between power supply node 1 and the base of starting transistor Q8. Transistor Q7 has its base connected to respective bases of transistors Q1, Q2, Q3 and Q9 of first current mirror circuit $\alpha$.

In the operation of the constant current circuit of FIG. 2, when the power supply is turned on, a current flows from each base of transistors Q1, Q2, Q3 and Q9 of first current mirror circuit $\alpha$ through transistor Q7 and resistor R4 to the base of starting transistor Q8. When the base current flows through starting transistor Q8, feedback transistor Q6 is turned on, and thereafter the same operation is performed as in the constant current circuit of FIG. 1, rendering the constant current circuit stable as a whole.

In the constant current circuit of FIG. 2, for example, points indicated by g, n, i, j, and k of starting circuit $\gamma 1$ tend to be disconnected. If any of the points is disconnected, starting transistor Q8 is not turned on according to the characteristics of a transistor. Accordingly, the aforementioned current feedback loop can not be formed, whereby the constant current circuit does not operate.

More specifically, in the constant current circuit of FIG. 2, starting transistor Q8 serves similarly as starting transistor Q8 in FIG. 1. Accordingly, for the same reason as in the constant current circuit of FIG. 1, such a defect as disconnection in the constant current circuit can be detected with certainty, as well as time and costs required for the test of the circuit can be reduced.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A constant current circuit providing a constant current, comprising:

a power supply node for receiving a power supply potential;

a first current mirror circuit for supplying an output current;

a second current mirror circuit for determining a reference current of said first current mirror circuit;

a feedback transistor means for generating current feedback for controlling the output current of said first current mirror circuit to match said reference current; and a starting circuit coupled between said feedback transistor means and said first current mirror circuit for starting said first current mirror circuit and said feedback transistor means, said starting circuit including a ground node for receiving a ground potential, and a switching element having a pair of current flow conducting electrodes coupled between at least said first current mirror circuit via said feedback transistor means and said ground node, and a current flow control electrode coupled to said first current mirror circuit for starting current flow between said pair of electrodes in response to said power supply potential being applied to said power supply node.

2. The constant current circuit in accordance with claim 1 wherein said switching element comprises a semiconductor switching element.

3. The constant current circuit in accordance with claim 1 wherein said switching element comprises a transistor.

4. The constant current circuit in accordance with claim 3 wherein said pair of current flow conducting electrodes comprises an emitter and a collector and said current flow control electrode comprises a base.

5. The constant current circuit in accordance with claim 4 wherein said emitter is coupled to said ground node, said collector is coupled to said feedback transistor, and said base is coupled to said first current mirror circuit.

6. The constant current circuit in accordance with claim 5 and additionally including a first coupling resistor connecting said switching element to said feedback transistor and a second coupling resistor connecting said switching element to said first current mirror circuit.

7. A constant current circuit providing a constant current, comprising:

a power supply node for receiving a power supply potential;

a ground node for receiving a ground potential;

a first current mirror circuit having its input node connected to said power supply node, for providing a current corresponding to a base current from its output node;

a second current mirror circuit of a band gap type connected between the output node of said first current mirror circuit and said ground node, for determining a reference current for the output current of said first current mirror circuit;

a feedback transistor having its base connected to a node between said first current mirror circuit and said second current mirror circuit, and its collector connected to the base and collector of said first current mirror circuit, and responsive to its base current for performing current feedback to said first current mirror circuit; and a starting circuit connected between said feedback transistor and said first current mirror circuit, and said ground node, for starting said first current mirror circuit and said feedback transistor, said starting circuit including a starting transistor having its emitter grounded to said ground node, a first resistor connected between the collector of said feedback transistor and the base of said starting transistor, and a second resistor connected between the emitter of said feedback transistor and the collector of said starting transistor.

8. A constant current circuit providing a constant current, comprising:

a power supply node for receiving a power supply potential;

a ground node for receiving a ground potential;

a first current mirror circuit having its input node connected to said power supply node for providing a current corresponding to a base current to its output node;

a second current mirror circuit of a band gap type connected between the output node of said first current mirror circuit and said ground node, for determining a reference current for the output current of said first current mirror circuit;

a feedback transistor having its base connected to a node between said first current mirror circuit and said second current mirror circuit, and its collector connected to the base and collector of said first current mirror circuit, and responsive to its base current for performing current feedback to said first current mirror circuit; and a starting circuit connected between said feedback transistor and said first current mirror circuit, and said ground node, for starting said first current mirror circuit and said feedback transistor, said starting circuit including a first transistor having its emitter grounded to said ground node, a second transistor having its base connected to said first current mirror circuit, and its collector connected to said power supply node, a first resistor connected between the emitter of said second transistor and the base of said first transistor, and a second transistor connected between the emitter of said feedback transistor and the collector of said first transistor.

* * * * *